US006313784B1

(12) United States Patent
Pittman et al.

(10) Patent No.: US 6,313,784 B1
(45) Date of Patent: Nov. 6, 2001

(54) MILLIMETER-WAVE ZOOM ANTENNA FOR GUILDING BEAMRIDER HYPERVELOCITY MISSILE

(75) Inventors: William C. Pittman, Huntsville; Raymond C. Bates, Attalla; John C. Fleischman, Hartselle; Ralph H. Halladay; Richard A. Lane, both of Huntsville, all of AL (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/575,593

(22) Filed: May 22, 2000

(51) Int. Cl.[7] ..... F41G 7/28
(52) U.S. Cl. ..... 342/62; 244/3.13
(58) Field of Search ..... 342/62; 244/3.13, 244/3.14; 701/223

(56) References Cited

U.S. PATENT DOCUMENTS 4,501,399 2/1985 Loomis, III ..... 342/62
5,473,331 * 12/1995 Kennedt et al. ..... 342/62

* cited by examiner

*Primary Examiner*—Daniel T. Pihulic
(74) *Attorney, Agent, or Firm*—Freddie M. Bush; Hay Kyung Chang

(57) ABSTRACT

The millimeter-wave zoom antenna for guiding a beamrider hypervelocity missile uses varying range information derived from the flight of the missile toward the target as control signals for the beam control computer to perform electronically the zooming and the nutation of the millimeter wave guidance beam that emits from a phased array antenna so as to maintain a constant energy density at the missile receiver regardless of the actual distance of the missile from the launch platform at any given time.

11 Claims, 3 Drawing Sheets

MILLIMETER-WAVE ZOOM ANTENNA FOR GUILDING BEAMRIDER HYPERVELOCITY MISSILE

The invention described herein may be manufactured, used and licensed by or for the Government for governmental purposes without the payment to us of any royalties thereon.

BACKGROUND OF THE INVENTION

There are certain advantages in beamrider guidance systems over terminal homing and command guidance systems for directing a missile toward a target. For example, because it is located on the rear of the missile and faces rear, the beamrider receiver is less vulnerable to countermeasures than the terminal homing receiver and the beacon tracker of the command guidance systems.

Briefly, performing beamrider guidance involves establishing a sight line to the selected target by optical or other suitable means and aligning the center line of the beam projector with the sight line. The beam that is emitted from the beam projector along the sight line is spatially encoded so that one part of the beam has some characteristic that renders it distinguishable from the other parts of the beam. This is usually accomplished by having a separate modulator for each part of the beam that imparts a distinguishing characteristic to each part. Into this beam, then, is the missile launched. The beamrider receiver on the missile senses the missile position relative to the center line of the modulated beam and develops command signals that constrain the missile to fly down the center line to the target. However, the optical or infrared beamrider guidance system is limited in usability because the rocket exhaust, dust and debris generated during launching tends to obscure the missile during the initial stage of the flight while weather effects may impair guidance performance during later stages.

SUMMARY OF THE INVENTION

Implementing the beamrider guidance system using millimeter wave technology not only overcomes the initial obscuration of the missile but also provides a means for maintaining a constant energy density at the missile as the missile flies down range as well as maintaining the same error signals for the same displacement from the center line.

The millimeter-wave zoom antenna for guiding a beamrider hypervelocity missile uses varying range information derived from the actual flight of the missile toward the target as a control signal for the beam control computer to perform electronically the zooming and the nutation of the millimeter wave guidance beam that emits from a phased array antenna.

DESCRIPTION OF THE PREFERRED EMBODIMENT

Figure 1:
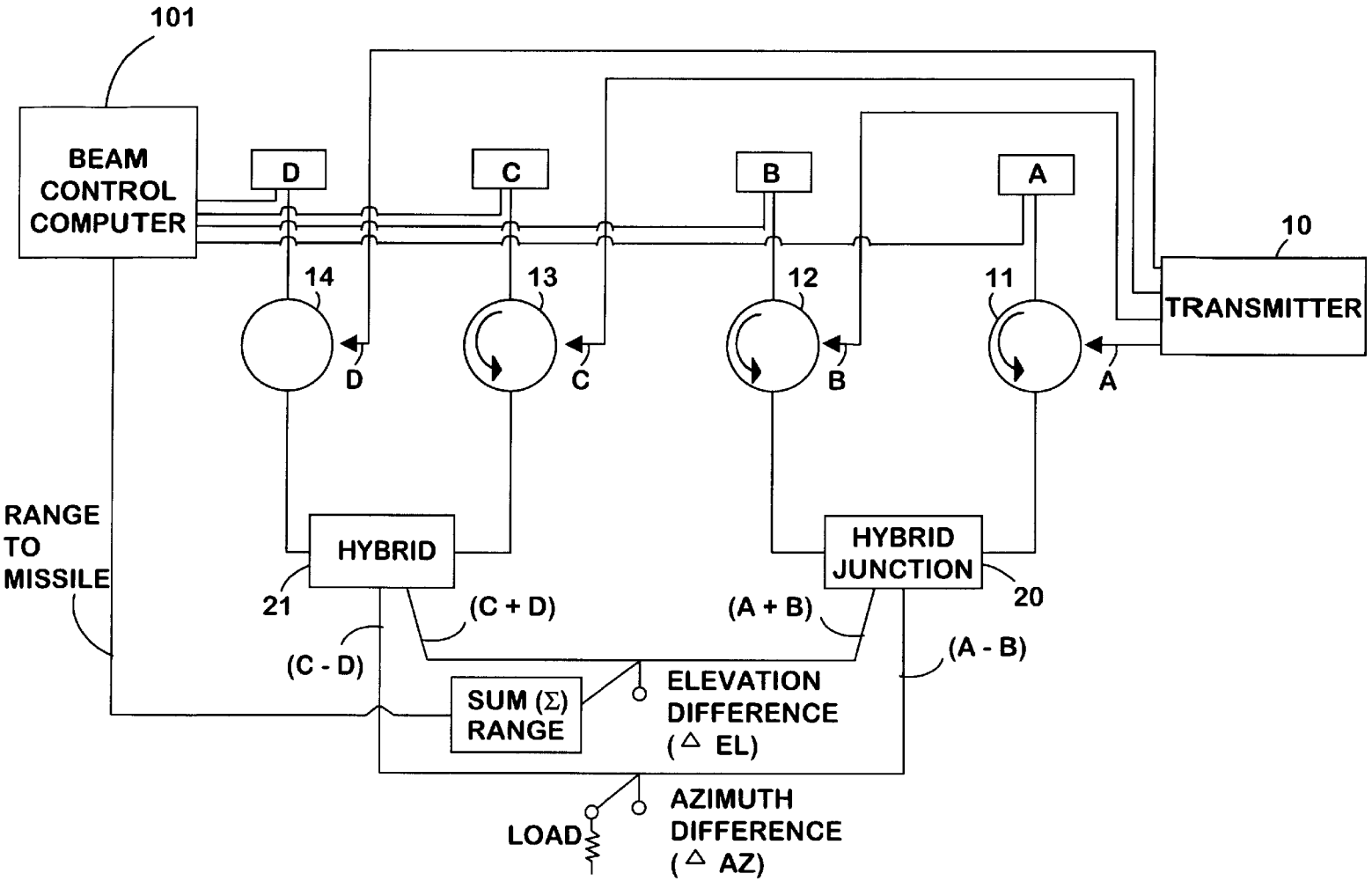
FIG. 1 is a diagram illustrating the use of the four-quadrant phased array antenna and the beam control computer to control the array antenna as a function of the varying missile range.

Referring now to the drawing wherein like numbers represent like parts in each of the several figures, presented below in detail is a description of the structure and operation of the millimeter-wave zoom antenna for guiding a beamrider hypervelocity missile toward impact on a pre-selected target.

In his U.S. Pat. No. 4,501,399 (Feb. 26, 1985) titled "Hybrid monopulse/sequential lobing beamrider guidance," Jester M. Loomis teaches a device that uses a combination monopulse and sequential lobing system to guide a vehicle toward a target by tracking the target with conventional monopulse technique while at the same time the vehicle is provided with coded data forming a cluster so as to provide spatial resolution information. The vehicle sequentially receives this information, stores the information until the sequence is complete and processes the information for guidance.

The instant invention may be thought of as an improvement to the Loomis device. The improvement is in the form of a phased array antenna comprised of four structurally and functionally identical quadrants each of which is, in turn, comprised of a plurality of antenna elements that operate in the millimeter wave region to emit and receive millimeter wave radiation. The quadrants A, B, C and D making up the phased array antenna 200 are coupled to and controlled by beam control computer 101 that determines and sets the amplitudes and phases of the individual antenna elements as a function of the varying missile range from the launch platform as the missile flies down range toward the target.

Initially beam control computer 101 determines the total number of radiating antenna elements required in the array to satisfy the minimum beamwidth in order to guide the missile to that particular target and the number of these antenna elements that need to be activated to generate all desired beamwidths greater than this minimum beamwidth. The various beamwidths correspond to the varying missile distance from the launch platform at any point in time during its flight from the launch platform to the target. Next, the computer calculates the Dolph-Tschebyscheff excitation coefficients for each of these active elements which will guarantee equal sidelobe suppression for all beamwidth settings. The beamwidth of the antenna is varied from a high value at launch to a low value at maximum range by programming the computer with the amplitudes of the excitation coefficients. This variation of the beamwidth achieves the "zooming" effect that maintains the energy density at the beamrider receiver of the missile constant regardless of the actual distance of the missile from the launch platform.

The mathematics involved in the calculation of the number of the antenna elements required for any desired beamwidth, i.e. the array size, as well as the Dolph-Tschebyscheff excitation coefficient for each of the activated elements to maintain a given sidelobe suppression for a particular beamwidth setting are well-known and is not presented here.

Prior to launch, the Dolph-Tschebyscheff excitation coefficients for all the antenna elements of the four quadrants are computed and stored in the beam control computer for different range increments from launch platform to target range. Then during the missile flight, the amplitudes of the millimeter wave radiation that is reflected from the missile and received by the four quadrants are routed by circulators 11, 12, 13 and 14 to hybrid junctions 20 and 21 where they are summed and this sum, containing the range information, is input to beam control computer 101. The result is that when the stored range and the range derived from the four quadrants coincide, the stored excitation coefficients are switched in progressively from the shortest range to target range in sequence. This progressive switching is done for all four quadrants simultaneously to achieve the beamwidths necessary to guide the missile toward the target.

Figure 2:
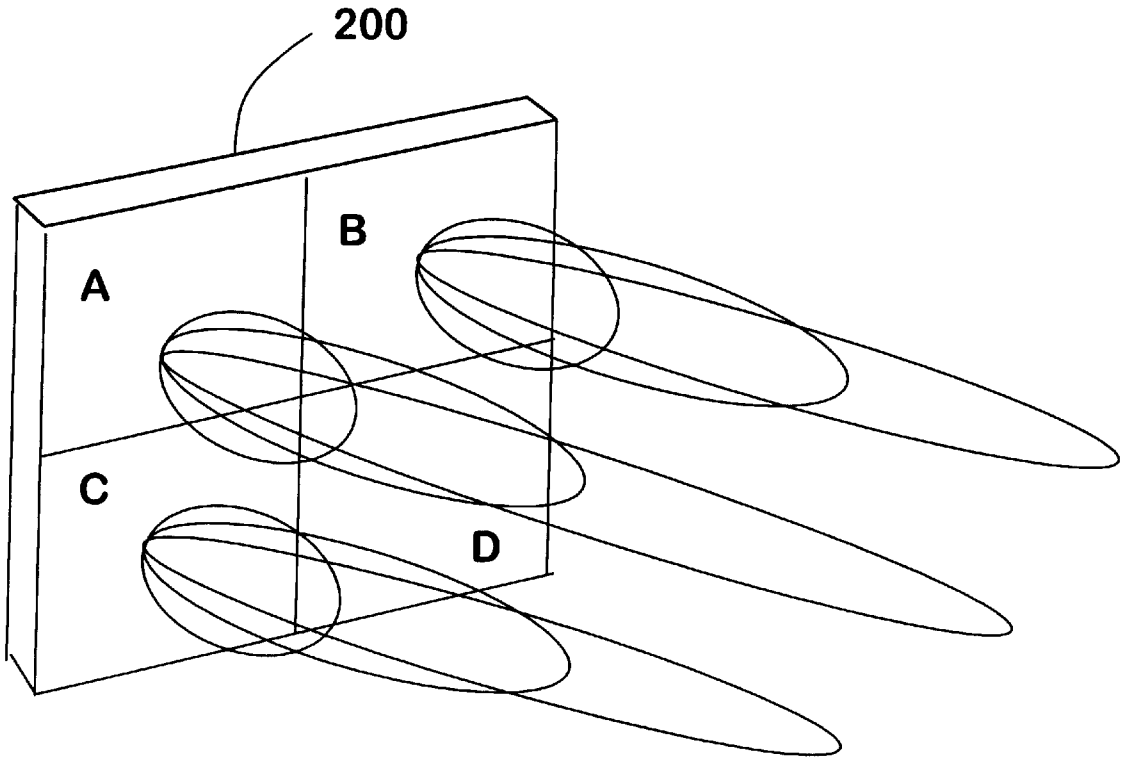
FIG. 2 depicts the four quadrants of the phased array antenna and variously shaped millimeter wave beams emanating from them in accordance with this invention.
Figure 3:
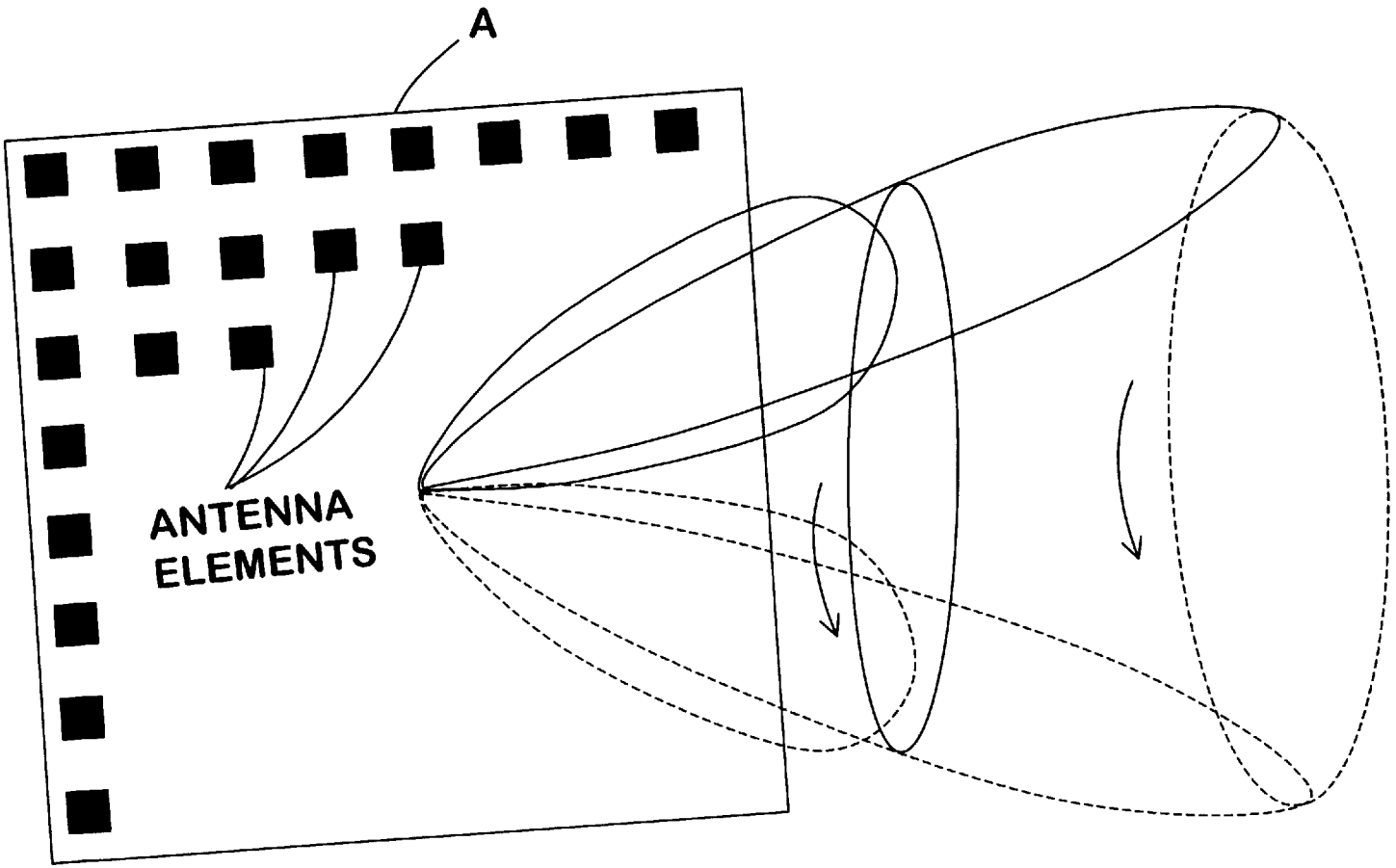
FIG. 3 shows the structure of a representative quadrant A and the nutation of the emitting beam.

The four quadrants of phased array antenna 200 are symmetrically arranged as shown in FIG. 2 and each quadrant is comprised of individual antenna elements disposed in a symmetrical configuration as depicted in FIG. 3. Further, each quadrant has symmetry in the y and z coordinates that implies that each row and column of the quadrant can have either an odd or even number of antenna elements. In the case of an odd number of elements, the center row or center column provides the starting point for calculating the Dolph-Tschebyscheff excitation coefficients. In the case of an even number of elements, the center two rows and center two columns provide the starting point. For a given number of elements in the quadrant and a given sidelobe level, the Dolph-Tschebyscheff excitation coefficient gives the smallest beamwidth (i.e. highest directivity). Since symmetry in the y and z coordinates means y and z have the same number of rows and columns and the spacing between the rows and columns is the same, the symmetry in the y and z coordinates leaves the symmetry of pattern structure along the boresight (i.e. x coordinate) unchanged even if the y and z coordinates are interchanged. In other words, if the four quadrants are rotated 90° about the boresight, there is no change in the pattern along the boresight. This implies that the amplitudes of the excitation coefficients taper off in the quadrant in a symmetrical fashion from the maximum value at the center to lower values at the horizontal and vertical edges.

Phased array antenna 200 offers another means for maintaining the energy density constant at the missile receiver: deflecting the beam at a fixed beamwidth from the center axis perpendicular to the array surface and nutating the beam in a circular motion in such a manner that the energy density at the missile receiver remains fixed at the missile flies down range. The radius of the nutation circle is kept constant at the missile as the missile flies down range. This is accomplished by varying the phases of the quadrants to deflect the beam with a fixed beamwidth in a prescribed circular pattern with a controllable radius. Alternatively, instead of circling smoothly, the beam can radiate from "up" and "down" and "left" and "right" positions as the angle of these deflections is varied during missile flight so as to maintain the sampled nutation circle radius constant at the missile. This sample method is a simpler means of phase control, since the "up" and "down" deflection requires the use of the columns of antenna elements only and the movement of the beam from "down" to "up" requires only a reversal of the progressive phases on the columns. Likewise, movement from "left" to "right" involves only the rows and a corresponding reversal of the progressive phases on the rows to effect movement from "right" to "left". All the settings of the phases are done by the computer in response to the range information derived by hybrid junctions 20 and 21.

Although a particular embodiment and form of this invention has been illustrated, it is apparent that various modifications and embodiments of the invention may be made by those skilled in the art without departing from the scope and spirit of the foregoing disclosure. Accordingly, the scope of the invention should be limited only by the claims appended hereto.

We claim:

1. A millimeter-wave antenna system for guiding a beam-rider hypervelocity missile toward impact on a pre-selected target, the missile having thereon a millimeter wave receiver, said millimeter-wave antenna system being capable of beam-shaping so as to achieve zooming effect in response to the varying range of the missile in flight from the launch platform to the target, said antenna system comprising: a phased array antenna having four quadrants, each quadrant being comprised of a plurality of antenna elements for emitting and receiving millimeter-wave beam; a means for producing a sum of the amplitudes of the millimeter wave received by said four quadrants, the received millimeter wave having reflected from the missile and said sum containing the missile range information; a plurality of circulators, said circulators being coupled between said quadrants and said producing means, said circulators selectively routing received millimeter-wave to said producing means; and a means for receiving said range information from said producing means and, in response, electronically adjusting the amplitudes and phases of said quadrants so as to yield an emitting guidance beam that maintains constant energy density at the missile receiver regardless of the distance of the missile from the launch platform, said adjusting means being coupled between said producing means and said phased array antenna.

2. A millimeter-wave antenna system for guiding a beam-rider hypervelocity missile toward impact on a pre-selected target as set forth in claim 1, wherein said receiving and electronically adjusting means comprises: a computer for modulating the amplitude and phase of said quadrants of said phased array antenna as a function of the missile range from the launch platform so as to maintain constant energy density at the missile receiver regardless of the distance of the missile from the launch platform.

3. A millimeter-wave antenna system as set forth in claim 2, wherein said computer has stored therein pre-determined Dolph-Tschebyscheff excitation coefficients corresponding to several various missile ranges between the launch platform and the target and accomplishes said modulation by progressively switching said Dolph-Tschebyscheff excitation coefficients in response to varying range of the missile, thereby setting the phase and amplitude of each of said antenna elements of each said quadrant in accordance with said switched excitation coefficients to achieve constancy of energy density of the emitted beam at the missile receiver.

4. A millimeter-wave antenna system as set forth in claim 3, wherein said quadrants are identical in structure and operation.

5. A millimeter-wave antenna system as set forth in claim 4, wherein each quadrant has symmetry in they and z coordinates.

6. A millimeter-wave antenna system as set forth in claim 5, wherein said symmetry in the y and z coordinates leaves the symmetry of pattern structure along the boresight unchanged as the y and z coordinates are interchanged.

7. In an antenna system for guiding a missile in its flight toward a pre-selected target, the missile having thereon a radiation receiver and the antenna system having a means for producing a sum of the amplitudes of received radiation, the received radiation having reflected from the missile and the sum containing the missile range information; a plurality of circulators, the circulators being coupled to the producing means for selectively routing the received radiation to the producing means; an IMPROVEMENT for electronically maintaining a constant energy density at the missile receiver, said IMPROVEMENT comprising; a phased array antenna having four quadrants, each quadrant being comprised of a plurality of antenna elements for emitting and receiving millimeter-wave beam, said phased array antenna being coupled to the circulators; and a means for receiving the range information from the producing means and, in response, electronically adjusting the amplitudes and phases of said quadrants so as to yield an emitting guidance beam that maintains constant energy density at the missile receiver regardless of the distance of the missile from the launch platform, said adjusting means being coupled between the producing means and said phased array antenna.

8. An antenna IMPROVEMENT as set forth in claim 7, wherein said receiving and electronically adjusting means comprises: a beam control computer, said computer having stored therein pre-determined Dolph-Tschebyscheff excitation coefficients corresponding to several various missile ranges between the launch platform and the target and modulating the amplitude and phase of said quadrants of said phased array antenna as a function of the varying missile range from the launch platform by selectively switching said Dolph-Tschebyscheff excitation coefficients in response to varying range of the missile and consequently setting the phase and amplitude of each of said antenna elements of each said quadrant so as to achieve constancy of energy density at the missile receiver.

9. A millimeter-wave antenna system as set forth in claim 8, wherein said quadrants are identical in structure and operation.

10. A millimeter-wave antenna system as set forth in claim 9, wherein the symmetry in the y and z coordinates preserves the rotational symmetry along the boresight.

11. A method for guiding a beamrider hypervelocity missile toward impact on a pre-selected target, the missile having thereon a millimeter wave detector, said method achieving zooming effect in response to the varying range of the missile in flight from the launch platform to the target and comprising the steps of:

a) calculating the total number of radiating antenna elements required in a phased array to create the minimum beamwidth to guide the missile to the target and the number of these antenna elements that need to be activated to generate all desired beamwidths greater than the minimum beamwidth;

b) determining the Dolph-Tschebyscheff excitation coefficients corresponding to several various missile ranges between the launch platform and the target and storing the determined coefficients in a beam control computer;

c) establishing a line of sight to the pre-selected target;

d) emitting a millimeter wave beam toward the target;

e) receiving millimeter wave radiation that reflects from the missile;

f) deriving the missile range information from the received millimeter wave radiation;

g) switching the Dolph-Tschebyscheff excitation coefficients selectively in response to varying range of the missile, thereby setting the phase and amplitude of each of the antenna elements of the phased array so as to achieve constancy of energy density of the emitted beam at the missile detector.

h) repeating the steps d) through g) continuously until final impact of the missile on the target.

* * * * *